US006067404A

United States Patent [19]

Wilkins et al.

[11] Patent Number: 6,067,404

[45] Date of Patent: May 23, 2000

[54] RADIANT ELECTRIC HEATER WITH FABRIC COVERING SHEET

[75] Inventors: Peter Ravenscroft Wilkins; David Aubrey Plumptre, both of Droitwich, United Kingdom

[73] Assignee: Ceramaspeed Limited, United Kingdom

[21] Appl. No.: 09/182,703

[22] Filed: Oct. 29, 1998

[30] Foreign Application Priority Data

Nov. 20, 1997 [GB] United Kingdom ..... 9724487
Dec. 24, 1997 [GB] United Kingdom ..... 97227137

[51] Int. Cl.[7] ..... H05B 3/26

[52] U.S. Cl. ..... 392/435; 219/520; 219/529

[58] Field of Search ..... 392/432, 435–439, 392/407, 426–429, 422; 219/213, 529, 548, 553, 460.1, 520; 338/306

[56] References Cited

U.S. PATENT DOCUMENTS

| | | | |
|---|---|---|---|
| 1,418,671 | 6/1922 | Patterson | 392/426 |
| 1,659,278 | 2/1928 | Meltzer et al. | 392/426 |
| 1,666,831 | 4/1928 | Pandolfo | 392/426 |
| 1,954,128 | 4/1934 | Heyroth et al. | 392/426 |
| 2,535,500 | 12/1950 | Looft | 392/426 |
| 2,715,668 | 8/1955 | Booker et al. | 392/432 |
| 2,952,761 | 9/1960 | Smith-Johannsen | 392/435 |
| 3,143,637 | 8/1964 | Rifenbergh | 392/432 |
| 3,479,490 | 11/1969 | Stark | 392/435 |
| 3,809,859 | 5/1974 | Wells | 392/435 |
| 3,869,596 | 3/1975 | Howie . | |
| 3,935,422 | 1/1976 | Barnes et al. | 392/432 |
| 4,017,967 | 4/1977 | Wells et al. | 392/435 |
| 4,247,979 | 2/1981 | Eck | 392/432 |
| 4,310,745 | 1/1982 | Bender . | |
| 4,602,238 | 7/1986 | Furtek | 392/435 |
| 4,833,288 | 5/1989 | Poumey . | |

FOREIGN PATENT DOCUMENTS

| | | |
|---|---|---|
| 2421528 | 1/1979 | France . |
| 2642929 | 8/1990 | France . |
| 1470563 | 4/1989 | Russian Federation . |
| 1089278 | 11/1967 | United Kingdom . |
| 1294513 | 11/1972 | United Kingdom . |
| 2170590 | 8/1986 | United Kingdom . |

*Primary Examiner*—John A. Jeffery
*Attorney, Agent, or Firm*—Ira S. Dorman

[57] ABSTRACT

A radiant electric heater (1) includes a heating element (4) and at least one covering sheet (7) spaced from the heating element. The at least one covering sheet is in the form of a fabric comprising glass filaments, ceramic filaments or metal filaments. Metal filaments, such as of a high temperature withstanding alloy, may be woven in the form of a fabric. Glass filaments, or ceramic filaments such as of aluminosilicate material, alumino-boro-silicate material or zirconia, may be of woven, knitted or mat form in the fabric. An apertured member (10) may be provided in contact with, or adjacent, to the covering sheet (7) of the fabric material.

15 Claims, 2 Drawing Sheets

RADIANT ELECTRIC HEATER WITH FABRIC COVERING SHEET

This invention relates to a radiant electric heater such as of the type in which one or more radiant electric heating elements is or are supported relative to (that is, on or adjacent to) a base of thermal and/or electrical insulation and/or reflective material.

FIELD OF THE INVENTION

The invention is particularly, but not exclusively, applicable to such heaters for use in cooking appliances, such as grills or ovens, including microwave ovens. It is, however, also applicable to such heaters for general applications, such as space heating and industrial thermal processing.

DESCRIPTION OF PRIOR ART

It is well known, particularly in cooking appliances, to provide radiant heaters in which one or more heating elements, such as of wire form, or ribbon form, or lamp form, is or are supported on or adjacent to a base of insulation material and/or reflective material, which may be provided in a housing, such as a support dish, such as of metal. It is particularly well known and advantageous to use, as a base, compacted microporous thermal and electrical insulation material.

For safe and satisfactory operation of such heaters it is required that manual contact with energised heating elements therein should be prevented. Furthermore, particulates such as of food materials should be prevented from contacting the heating elements and any insulating and/or reflecting materials provided in the heater. Such particulates, and also liquids, may be splattered towards the heater during cooking operations and vapours may also be emitted towards the heater.

A further problem, particularly encountered with heaters for use in ovens and grills, is that particulate materials in the heater, such as particles of insulation material, may become dislodged and must be prevented from falling into the oven or grill and contaminating food being processed therein.

The aforementioned problems have hitherto been solved by operating the heater behind a sheet of glass-ceramic material. Such glass-ceramic material is expensive and also reduces the thermal performance of the heater.

OBJECT OF THE INVENTION

It is therefore an object of the present invention to provide a radiant electric heater which eliminates or at least ameliorates the above problems without the use of a sheet of glass-ceramic material.

SUMMARY OF THE INVENTION

According to the present invention there is provided a radiant electric heater including a heating element, wherein at least one covering sheet is spaced from the heating element, the at least one covering sheet being in the form of a fabric comprising glass filaments, ceramic filaments or metal filaments.

The metal filaments may be of woven form in the fabric.

The metal filaments may comprise a high temperature withstanding alloy such as stainless steel.

The glass or ceramic filaments may be of woven, knitted or mat form in the fabric.

The ceramic filaments may comprise alumino-silicate material or alumino-boro-silicate material or zirconia.

The glass filaments may comprise glass fibres selected from E glass, C glass, R glass, S glass and modifications thereof.

The weight per unit area of the fabric may be generally not greater than 1 $kg/m^2$ and may preferably be in the range from 50 to 300 $g/m^2$.

The heating element may be supported on or adjacent to a base of insulation material, such as of microporous thermal insulation material. The insulation material may be provided in a dish-like support, such as of metal.

A peripheral wall of thermal insulation material may be provided for the heater. The at least one covering sheet of the fabric may be arranged to overlie an outer surface of the peripheral wall.

The heater may include one or more heating elements of wire, ribbon or lamp form.

An apertured member may be provided in contact with, or adjacent to, the at least one covering sheet of the fabric. For example, the apertured member may serve as a support for the at least one covering sheet and/or as an electrical screen when formed of electrically conductive material and/or as protection, for the heater. The apertured member may comprise a perforated sheet or a lattice arrangement, of metal, ceramic or other suitable refractory material.

The heater of the invention is particularly applicable to cooking appliances, such as grills, ovens especially microwave ovens, deep fat fryers. However it is also applicable in other applications, such as in space heating and in industrial thermal processing operations.

The at least one sheet of the fabric serves as an efficient barrier to particulate materials and liquid splashing, such as arising from cooking operations. It also reduces passage into the heater of vapours.

The invention is now described by way of example with reference to the accompanying drawings, in which:

DESCRIPTION OF PREFERRED EMBODIMENT

Figure 1:
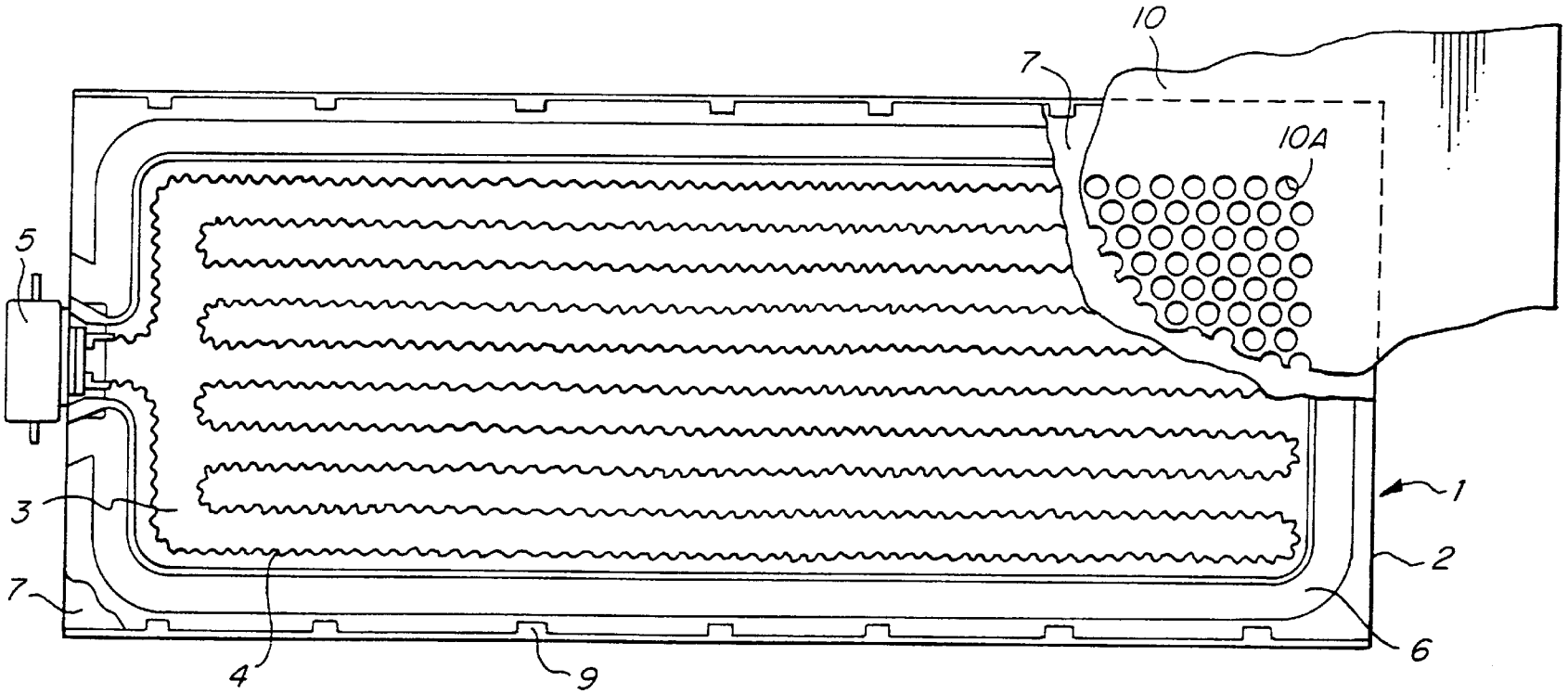
FIG. 1 is a plan view of a radiant electric heater according to the present invention.

Referring to the drawings, a radiant electric heater 1 comprises a metal dish-like support 2 provided with a base layer 3 of compacted microporous thermal and electrical insulation material. As shown in FIG. 1, the dish-like support 2 is formed with a plurality of depressed regions of arcuate form which permit the material of the base layer 3 to engage around the arcuate portions to assist in securing the base layer in the dish-like support.

A heating element 4 is provided secured to the base layer 3. As shown, the heating element 4 comprises a corrugated metal ribbon mounted edgewise on the base layer 3 and secured by partial embedding in the base layer 3. Such a heating element is well known to the skilled person. The heating element 4 could instead be of coiled wire or coiled ribbon form or of lamp form or of any other form known to the skilled person. More than one form of heating element could also be provided in the heater.

A terminal block 5 for the heating element is mounted on the heater and allows the heater to be connected to a voltage supply for operation.

A peripheral wall 6 of thermal insulation material is provided in the heater. As shown, this wall is integral with the base layer 3. However it could be provided as a separate member, as is well known in the art.

In order to prevent contact with internal components of the heater, such as the heating element 4 and insulation 3, by particulate materials and to reduce ingress of vapours, during operation of the heater, for example in a cooking appliance, at least one sheet 7 of a fabric comprising glass, ceramic or metal filaments is provided spaced from the heating element. When metal filaments are employed, these comprise a suitably high temperature withstanding alloy, such as a stainless steel, and fine wire filaments, which may be as little as 25 microns in diameter, are woven together to form the fabric.

When glass or ceramic filaments are employed, these may be woven, knitted or matted to form the fabric.

The ceramic filaments may comprise alumino-silicate materials, such as supplied by the Carborundum Company Ltd. under the trade names Fibertex and Fibersil.

A fabric of woven alumino-boro-silicate filaments may be employed, such as supplied by 3M Company under the trade name Nextel.

A zirconia cloth fabric may also be considered, for example as supplied by Zircar Products Inc.

The glass filaments may comprise fibres of E glass, C glass, R glass or S glass or modifications thereof. For example, the boron oxide in E glass may be replaced by magnesium oxide, such a glass being commercially available, under the trade name Advantex, from OCF Corporation.

The weight per unit area of the fabric sheet 7 should be arranged to be as small as is practicable to ensure optimum thermal efficiency of the heater. In general the weight per unit area of the fabric should be less than 1 $kg/m^2$, with a typical weight per unit area being in the range from 50 to 300 $g/m^2$ for glass and ceramic filament fabrics, but somewhat greater for metal filament fabrics.

The sheet or sheets 7 are at least partially translucent to allow the transmission therethrough of visible and infra-red radiation from the heating element 4. Additionally, especially in the case of metal filament fabrics, the fabric may absorb and re-radiate radiation from the heating element.

Figure 2:
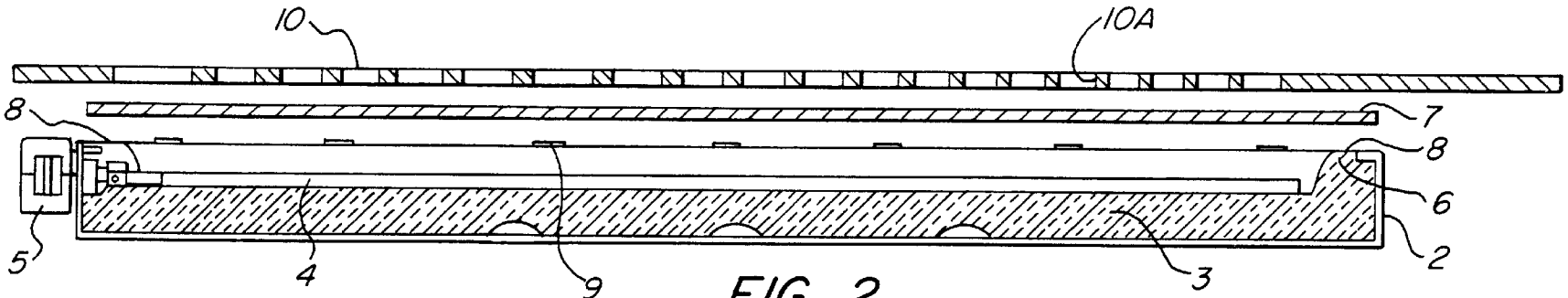
FIG. 2 is a cross-sectional view, in partly exploded form, of the heater of FIG. 1.
Figure 4:
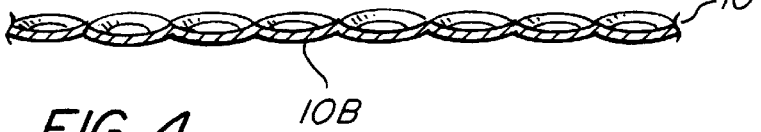
FIG. 4 is a fragmentary sectional view of the material of FIG. 3.
Figure 3:
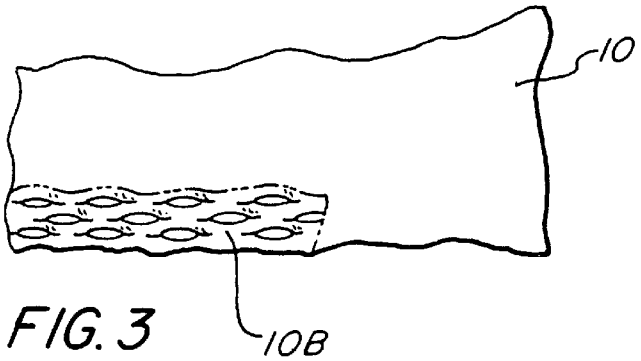
FIG. 3 is a fragmentary plan view showing, as an alternative perforated member, a lattice arrangement of material.

The or each sheet 7 overlies the outer surface 8 of the peripheral wall and covers the heater and is suitably secured by adhesive, or staples, or bent over tags 9 which may be integral with the metal support 2. It should be noted that in the partially exploded view of FIG. 2 the bent over tags 9 will in practice sandwich the or each sheet 7 between the tags 9 and the peripheral wall. Alternatively the sheet or sheets 7 may be secured at edges thereof to the outside of the support 2 by adhesive or other means.

Thus the heating element 4 is spaced from the or each sheet 7 and there is no contact therebetween. The spacing eliminates direct contact between the heating element 4 and the sheet or sheets 7 so as to minimise the thermal capacity of the heating element and to enable the same to reach full operating temperature as quickly as possible. The spacing also protects the user from the electrical potential of the heating element, especially where the sheet or sheets are of metal filaments.

An apertured sheet 10 is optionally provided overlying the one or more sheets 7 of the fabric. Such apertured sheet may serve more than one purpose. It may provide support and/or protection for the sheet or sheets 7 of the fabric, enabling the thickness of the sheet or sheets to be minimised and also minimising the risk of manual contact with internal components of the heater. The apertured sheet can comprise perforations 10A in a metal or ceramic sheet or the sheet can be of expanded metal form 10B, or other appropriate lattice-form. The sheet 10 could alternatively comprise any suitably apertured refractory material.

In applications of the heater such as in microwave ovens, where electrical screening of the heater is required in respect of electromagnetic radiation generated elsewhere in the oven, the apertured sheet 10, formed of metal, also or alternatively fulfils this screening function.

We claim:

1. A radiant electric heater including an inner base wall and a peripheral wall projecting outwardly therefrom to cooperatively define an outwardly opening cavity; at least one heating element contained in the cavity; and at least one covering fabric sheet operatively supported by the peripheral wall in overlying relationship to the cavity and separated from the heating element by an air space, the base wall and peripheral wall being formed of thermal insulation material, and the at least one fabric covering sheet being formed of glass filaments.

2. A radiant electric heater according to claim 1, wherein the glass filaments comprise glass fibres selected from E glass, C glass, R glass, S glass.

3. A radiant electric heater according to claim 1, wherein the weight per unit area of the fabric is not greater than 1 $kg/m^2$.

4. A radiant electric heater according to claim 3, wherein the weight per unit area of the fabric is in the range from 50 to 300 $g/m^2$.

5. A radiant electric heater according to claim 1, wherein the insulation material comprises microporous thermal insulation material.

6. A radiant electric heater according to claim 1, wherein the insulation material is provided in a dish-like support.

7. A radiant electric heater according to claim 6, wherein the dish-like support comprises metal.

8. A radiant electric heater according to claim 1, wherein the at least one covering sheet of the fabric is arranged to overlie an outer surface of the peripheral wall.

9. A radiant electric heater according to claim 1, wherein the at least one heating element is of ribbon form.

10. A radiant electric heater according to claim 1, wherein an apertured member is provided in contact with the at least one covering sheet of the fabric.

11. A radiant electric heater according to claim 10, characterised in that the apertured member is selected from a perforated sheet and a lattice arrangement of material selected from metal, ceramic and refractory material.

12. A radiant electric heater according to claim 1, wherein an apertured member is provided adjacent to the at least one covering sheet of the fabric.

13. A radiant electric heater according to claim 12, characterised in that the apertured member is selected from a perforated sheet and a lattice arrangement of material selected from metal, ceramic and refractory material.

14. A radiant electric heater including an inner base wall and a peripheral wall projecting outwardly therefrom to cooperatively define an outwardly opening cavity; at least one heating element contained in the cavity; and at least one covering fabric sheet operatively supported by the peripheral wall in overlying relationship to the cavity and to an outer surface of the peripheral wall, and separated from the heating element by an air space, the base wall and peripheral wall being formed of a microporous thermal insulation material, and the at least one fabric covering sheet being formed of glass filaments.

15. A radiant electric heater according to claim 21, wherein the heater further includes a metal, dish-like support for the insulation material.

* * * * *